US009538846B2

(12) United States Patent
Reinhart et al.

(10) Patent No.: US 9,538,846 B2
(45) Date of Patent: Jan. 10, 2017

(54) SHELVING SYSTEM AND SHELF FOR SAME

(71) Applicant: Centrex Plastics, LLC, Findlay, OH (US)

(72) Inventors: Terrence Lee Reinhart, Findlay, OH (US); Nickolas Lee Reinhart, Findlay, OH (US)

(73) Assignee: CONTINENTAL COMMERCIAL PRODUCTS, LLC, Bridgeton, MO (US)

( * ) Notice: Subject to any disclaimer, the term of this patent is extended or adjusted under 35 U.S.C. 154(b) by 0 days.

(21) Appl. No.: 13/901,004

(22) Filed: May 23, 2013

(65) Prior Publication Data

US 2014/0263136 A1 Sep. 18, 2014

Related U.S. Application Data

(60) Provisional application No. 61/792,451, filed on Mar. 15, 2013.

(51) Int. Cl.

| | |
|---|---|
| ***A47B 47/00*** | (2006.01) |
| ***A47B 96/02*** | (2006.01) |
| ***A47B 47/04*** | (2006.01) |

(52) U.S. Cl.

CPC ..... *A47B 96/02* (2013.01); *A47B 47/045* (2013.01); *A47B 96/021* (2013.01)

(58) Field of Classification Search

CPC ..... A47B 45/00; A47B 47/00; A47B 47/045; A47B 47/047; A47B 96/021; A47B 96/02

USPC ..... 211/134, 186, 187, 188, 153, 189, 190,211/194, 195; 108/91, 106, 186, 11

See application file for complete search history.

(56) References Cited

U.S. PATENT DOCUMENTS

| | | | | |
|---|---|---|---|---|
| 1,747,691 | A * | 2/1930 | Bellows | 108/129 |
| 1,976,031 | A * | 10/1934 | Lowenberg | 108/12 |
| 3,053,558 | A | 9/1962 | Challas, Jr. et al. | |
| 3,669,033 | A | 6/1972 | Murcia | |
| 3,734,032 | A | 5/1973 | Kovacik | |
| 3,788,242 | A | 1/1974 | Hassel et al. | |
| D245,744 | S | 9/1977 | Brooks | |
| 4,099,472 | A | 7/1978 | Kellogg | |
| D249,618 | S | 9/1978 | Oxenhandler | |
| 4,145,977 | A | 3/1979 | Yellin | |
| 4,467,927 | A | 8/1984 | Nathan | |
| 4,574,709 | A | 3/1986 | Lackey et al. | |
| 4,593,825 | A | 6/1986 | Hepp | |
| 4,615,278 | A | 10/1986 | Cabrelli | |
| 4,621,740 | A | 11/1986 | Lang | |
| 4,706,576 | A | 11/1987 | James | |
| 4,815,394 | A * | 3/1989 | Ettlinger et al. | 108/107 |
| 4,843,975 | A | 7/1989 | Welsch et al. | |
| 4,852,501 | A | 8/1989 | Olson et al. | |
| 4,940,150 | A | 7/1990 | Spengler | |
| 4,953,719 | A | 9/1990 | Spamer | |
| 4,998,023 | A | 3/1991 | Kitts | |
| 5,158,187 | A | 10/1992 | Taub | |
| D330,652 | S | 11/1992 | Goetz | |

(Continued)

*Primary Examiner* — Stanton L Krycinski

(74) *Attorney, Agent, or Firm* — Banner & Witcoff, Ltd.

(57) ABSTRACT

Improved shelves are disclosed for shelving systems comprising one or more such improved shelves and support posts. Elongate elements along the underside of the shelves have post-receiving recesses to receive support posts along the underside of the shelf during storage and shipment. The improved shelves and shelving systems allow greater efficiency in packaging, shipping and storage.

17 Claims, 4 Drawing Sheets

(56) References Cited

U.S. PATENT DOCUMENTS

| | | | | | |
|---|---|---|---|---|---|
| D330,819 | S | | 11/1992 | Dickinson | |
| 5,218,914 | A | * | 6/1993 | Dickinson | 108/64 |
| 5,238,128 | A | * | 8/1993 | Stoddard | 211/188 |
| D344,382 | S | | 2/1994 | Conaway | |
| 5,293,704 | A | * | 3/1994 | Brown | 38/102.9 |
| 5,303,645 | A | | 4/1994 | Meacham | |
| D347,131 | S | | 5/1994 | Wolff | |
| D362,138 | S | | 9/1995 | Sagol et al. | |
| 5,588,541 | A | | 12/1996 | Goetz | |
| 5,683,004 | A | | 11/1997 | Aho | |
| 5,709,158 | A | | 1/1998 | Wareheim | |
| 5,752,610 | A | | 5/1998 | Remmers | |
| 5,964,163 | A | * | 10/1999 | Cohen | 108/91 |
| 6,015,053 | A | * | 1/2000 | Sheng | 211/188 |
| 6,079,339 | A | | 6/2000 | Houk, Jr. et al. | |
| 6,178,896 | B1 | | 1/2001 | Houk, Jr. et al. | |
| 6,820,757 | B2 | * | 11/2004 | Craft et al. | 211/188 |
| 6,892,993 | B2 | * | 5/2005 | Palmer | 248/346.02 |
| 7,640,868 | B2 | * | 1/2010 | Morrison et al. | 108/91 |
| 7,658,154 | B2 | * | 2/2010 | Yankello et al. | 108/190 |
| 7,770,743 | B1 | * | 8/2010 | Janowak et al. | 211/119.12 |
| 8,001,911 | B2 | * | 8/2011 | Yankello et al. | 108/190 |
| 8,141,723 | B2 | * | 3/2012 | Whalen et al. | 211/135 |
| 8,146,517 | B1 | * | 4/2012 | Masser et al. | 108/64 |
| 8,215,245 | B2 | * | 7/2012 | Morrison et al. | 108/91 |
| 8,601,954 | B1 | * | 12/2013 | Steinbok | 108/11 |
| 2002/0046982 | A1 | * | 4/2002 | Guizzardi | 211/187 |
| 2002/0092818 | A1 | * | 7/2002 | Craft et al. | 211/188 |
| 2005/0040307 | A1 | * | 2/2005 | Palmer | 248/346.02 |
| 2008/0053940 | A1 | * | 3/2008 | Whalen et al. | 211/134 |
| 2008/0072802 | A1 | * | 3/2008 | de Oliveira | 108/12 |
| 2009/0242501 | A1 | * | 10/2009 | Yankello et al. | 211/153 |
| 2010/0257673 | A1 | * | 10/2010 | Linares | 5/626 |
| 2011/0012392 | A1 | * | 1/2011 | Herschler | 297/139 |

* cited by examiner

SHELVING SYSTEM AND SHELF FOR SAME

PRIORITY CLAIM

This application claims priority to U.S. Provisional Application Ser. No. 61/792,451 filed Mar. 15, 2013 and titled "Shelving System and Shelf for Same", the entire disclosure of which is hereby incorporated by reference.

BACKGROUND OF THE INVENTION

The present invention relates to improved shelving systems and to shelves and posts for such shelving systems. More particularly, the invention relates to shelving systems configured for greater efficiency in packaging, shipping and storage.

There is a need for affordable shelving, such as shelving systems that provide good aesthetics, flexibility of use, and good functionality. Some shelving systems require significant assembly, which consumers may not want to or may not be able to undertake. Many consumers, for example, do not have tools or aptitude to assemble wall-mounted shelves.

Freestanding shelving systems are known in which rectangular shelving panels have four sockets integrally formed in the corners of the panels. Each successive panel is mounted above the one below by four support posts receivable into the sockets. Shelving of this type can be produced and shipped unassembled. It is often bulky, however, making packaging and shipping of such shelving systems more costly and difficult. A bulky packaged shelving system for shipment will take up more room on a shipping pallet and thereby reduce the number of shelving systems that can be shipped at a time.

It would be desirable to have shelving systems that are structurally robust and yet that can be packaged compactly for more efficient shipping and storage.

SUMMARY OF THE INVENTION

As best appreciated with reference to the following disclosure and the description of certain embodiments, including the discussion of the particular embodiments shown in the appended drawings, the invention here provides improved shelves for a shelving system as well as shelving systems incorporating such improved shelves. Optionally, all of the shelves used in a shelving system in accordance with certain embodiments are identical. In alternative embodiments, some of the shelves of the shelving system have one or more of the improvements disclosed here, while other shelves of the same shelving system do not. In general, the shelving systems may have any number of shelves, for example to shelves, three shelves, for shelves or more. The shelving systems may be packaged and sold together with the required number of support posts. For example, for shelving systems wherein each shelf is spaced from the next adjacent shelf by a set of four posts at the corner areas of the shelves, a 4-shelf shelving assembly will have 12 posts. Correspondingly, such 4-shelf shelving assembly with 12 posts typically is packaged for storage and transportation with the shelves stacked adjacent each other posts trapped between adjacent shelves. It will be appreciated from the following that shelving systems comprising the improved shelves disclosed and discussed can be packaged in this manner more compactly. A greater quantity of the more compactly packaged shelving systems can be loaded and shipped in any given size shipping container. Similarly, a greater quantity can be held on a store shelf, thereby reducing the required frequency of restocking.

In one aspect a shelf for a multi-shelf shelving system, for example, an injection molded plastic shelf, has a primary shelf surface, a shelf underside below the primary shelf surface, a plurality of sockets in the shelf configured to receive an end of a corresponding support post, and a plurality of elongate elements, such as flanges or pins would like extending along at least a portion of the shelf underside. The elongate elements are unitary with the primary shelf surface and enhance the strength or rigidity of the shelf. At least some of the elongate elements, that is, each of at least a first set of the elongate elements, has at least one generally downwardly open post-receiving recess configured to receive a support post positioned generally parallel to the primary shelf surface, for example, during storage or shipping of the post and shelf together as parts of a multi-shelf shelving system. In accordance with certain embodiments, a sufficient number of post-receiving recesses are provided in the shelf underside to accommodate multiple support posts. As further discussed below, nesting a support post into the post-receiving recess or nesting multiple posts into multiple aligned sets of post-receiving recesses in the underside of a shelf allows the shelf to be stacked more closely to an adjacent shelf for storage and shipping. The stacking compactness achieved in this way enables a significant increase in efficiency and corresponding economic benefits.

In certain embodiments the elongate elements are parallel to each other, and the post-receiving recess of a first elongate element is aligned with the post-receiving recess of one or more others of the elongate elements. Where the elongate elements are spaced from each other, they can receive the same support post (i.e., different locations of the same support post) in their respective post-receiving recess during storage or shipping of the post and shelf together. The dimensions of the host-receiving recesses need not be the same in all of the elongate elements. For example, some of the elongate elements may have major recesses while others have more shallow recesses. Thus, in a set of parallel elongate elements extending along the underside of the shelf, larger, more robust elongate elements with deeper post-receiving recesses may be spaced apart, with smaller ones of the parallel elongate elements spaced between the larger ones. The post-receiving recesses in the smaller elongate elements may be correspondingly shallower than those in the larger elongate elements. In this way, the shelf can be designed to have adequate strength and rigidity while avoiding excess material cost and weight. In certain such embodiments, the larger elongate elements can be spaced from each other a distance approximately equal to, but not less than the length of the support posts which will be received by them during shipping and storage.

In at least certain embodiments the configuration of the post-receiving recesses corresponds to the cross-sectional configuration of the support posts they receive. Thus, for example, in shelving systems according to this disclosure wherein the support posts are tubular with a round cross-section, the post-receiving recesses can be curvilinear, e.g., semicircular or, if more shallow, having the configuration of an arc of a circle. It should be understood that, as the term is used here, a semicircular recess is not necessarily precisely 180° of a circle. In alternative embodiments, the post-receiving recess may have a rectilinear configuration or any configuration that is suitable to receive a support post along the underside of the shelf parallel to the primary shelf surface during storage and shipping of a shelving unit incorporating the shelf.

In accordance with another aspect, a shelving system has multiple shelves and multiple support posts, for example, multiple injection molded one-peace plastic shelves (which may be identical to each other or not) and a corresponding number of injection molded or extruded one-peace plastic tubular support posts. At least one of the injection molded shelves is of the improved type described above, having an upwardly facing primary shelf surface, a shelf underside below and unitary with the primary shelf surface, sockets to receive support posts, for example, a plurality of vertically extending sockets in the corner areas of the shelf configured to receive an end of a corresponding one of the support posts, and a plurality of elongate elements extending along at least a portion of the shelf underside. The elongate elements are unitary with the primary shelf surface and enhance the strength or rigidity of the shelf. In addition, each of the elongate elements (or at least each of a subset of the elongate elements of the shelf) has one or more generally downwardly-open post-receiving recesses configured to receive one of the support posts along the underside of the shelf parallel to the primary shelf surface during storage or shipping of the post and shelf together. In certain embodiments first and second post-receiving recesses of a first elongate element are aligned with first and second post-receiving recesses, respectively, of a second elongate element. Where these two elongate elements are spaced from each other, the advantage can be achieved during storage or shipping of the shelf together with the support posts, that the first post-receiving recesses of the elongate elements receive a first support post along the shelf underside (between adjacent shelves) perpendicular to the elongate elements. Likewise, the second post-receiving recesses of these elongate elements receive a second support post also positioned along the shelf underside perpendicular to the elongate elements and parallel to the first support post. Thus, it will be understood that multiple support posts can be nested in the post-receiving recesses of a single shelf when that shelf is stacked with others for storage or shipment.

As noted above, in certain embodiments of the shelving systems disclosed here multiple shelves of the shelving system (and in some embodiments all of the shelves of the shelving system) have the size and configuration. For example, all the shelves may be identical. Optionally, the shelves may be stacked for storage or shipment such that the underside of one shelf faces the underside of another shelf. In certain embodiments, therefore, one or more support posts of the shelving system may be placed between the facing shelves so as to be received by the post-receiving recesses of the elongate elements of both shelves. In this way, the depth of any post-receiving recess need not be more than one half the cross-sectional dimension of the support posts.

Those skilled in the art of shelving systems will appreciate from this disclosure that there are numerous different embodiments of the shelves and shelving systems of the present invention providing greater efficiency in packaging, shipping and storage, including, for example, various injection molded embodiments providing advantages such as interchangeable and interconnectable components configured for quick and fastener-less assembly, and optionally also configured for adjustability, aesthetics, flexibility of use, and functionality.

BRIEF DESCRIPTION OF THE DRAWINGS

A more complete understanding of the present disclosure and the advantages thereof may be acquired by referring to the following description in consideration of the accompanying drawings, in which like reference numbers indicate like features, and wherein.

DETAILED DESCRIPTION OF CERTAIN EMBODIMENTS OF THE INVENTION

Figure 1:
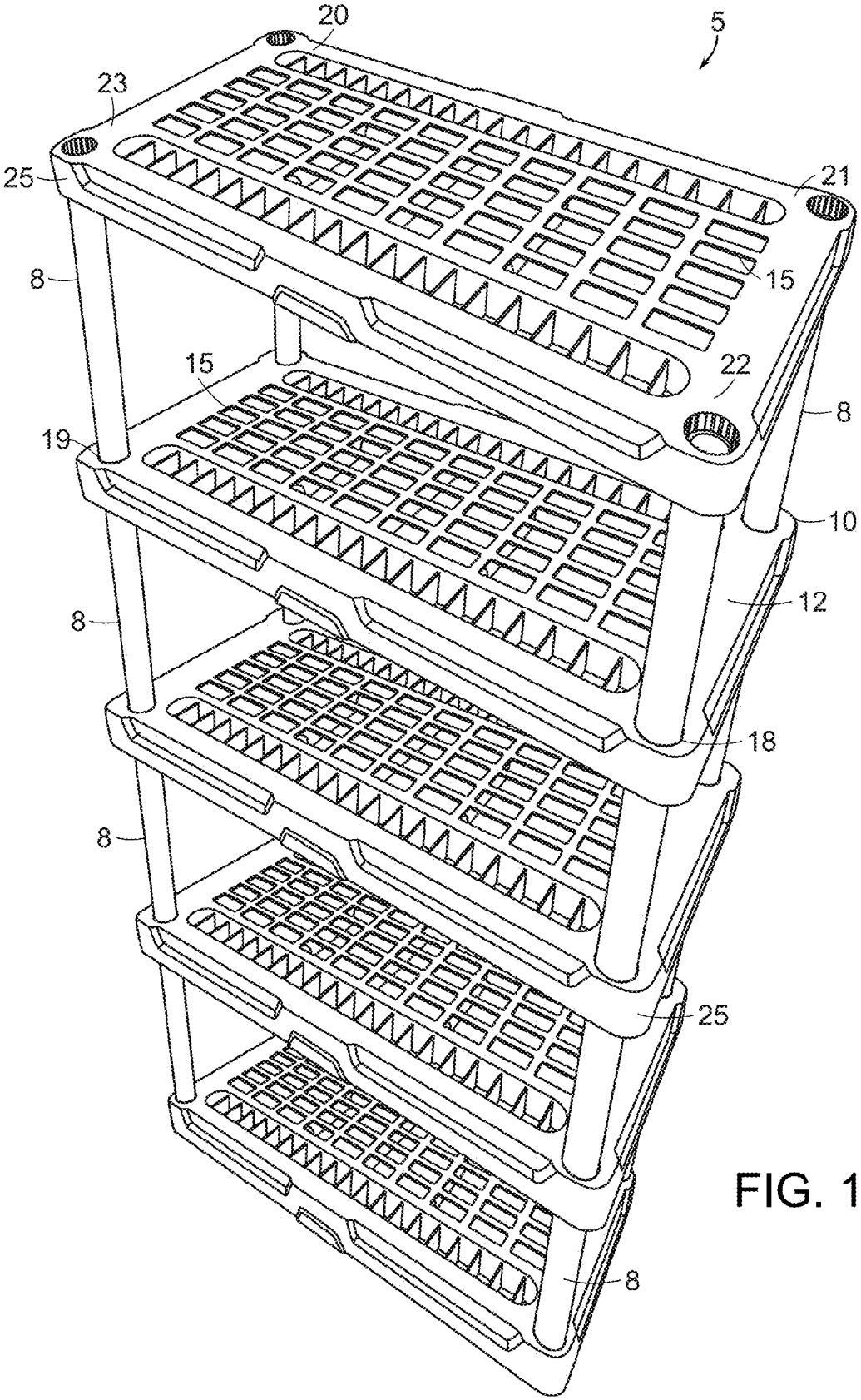
FIG. 1 is a perspective view of an assembled shelving system in accordance with the present disclosure, comprising five injection molded plastic shelves improved in accordance with the present disclosure and corresponding support posts received in sockets of the shelves to support and space the shelves.

Various different examples and embodiments of the inventive subject matter disclosed here are possible and will be apparent to the person of ordinary skill in the art, given the benefit of this disclosure. In this disclosure reference to "some embodiments," "certain embodiments," "certain exemplary embodiments" and similar phrases each means that those embodiments are merely non-limiting examples of the inventive subject matter, and there are alternative embodiments which are not excluded. Unless otherwise indicated or unless otherwise clear from the context in which it is described, alternative and optional elements or features in any of the disclosed embodiments and examples are interchangeable with each other. That is, an element described in one embodiment or example should be understood to be interchangeable or substitutable for one or more corresponding but different elements in another described example or embodiment and, likewise, an optional feature of one embodiment or example may optionally also be used in other embodiments and examples. More generally, the elements and features of any disclosed example or embodiment should be understood to be disclosed generally for use with other aspects and other examples and embodiments. A reference to a component being operative or configured to perform one or more specified functions, tasks, and/or operations or the like, is intended to mean that it can perform such function(s), task(s), and/or operation(s) in at least certain embodiments, and may well be able to perform one or more other functions, tasks, and/or operations. While this disclosure mentions specific examples and embodiments, those skilled in the art will appreciate that there are numerous variations and modifications within the spirit and scope of the invention as set forth in the appended claims. Each word and phrase used in the claims is intended to include all its dictionary meanings consistent with its usage in this disclosure and/or with its technical and industry usage in any relevant technology area. Indefinite articles, such as "a," and "an" and the definite article "the" and other such words and phrases are used in the claims in the usual and traditional way in patents, to mean "at least one" or "one or more." The word "comprising" is used in the claims to have its traditional, open-ended meaning, that is, to mean that the product or process defined by the claim may optionally also have additional features, elements, etc. beyond those expressly recited in the claim. The phrase "consisting essentially of" is used to signal that the product or process defined necessarily includes the listed components and is open to unlisted components that do not materially affect the basic and novel properties of the invention.

As used here and in the accompanying claims, directional terms used in describing the shelves and shelving units disclosed here should be understood to have their ordinary meaning with reference to gravity, including, e.g., up, down, over, under, etc. Accordingly, for example, an up-down direction is vertical as that term is commonly used. It should be further understood, however, that directional or positional references to portions of a shelf or shelving system disclosed here refer to the orientation of the shelf or shelving system in ordinary use. Thus, the underside of a shelf is the side normally facing down when the shelf is assembled in a shelving unit in its intended or ordinary configuration. In keeping with that understanding, the primary shelf surface is the upper surface of a shelf as assembled in a shelving unit, i.e., the surface on which items would ordinarily be placed for storage or display on the shelf. The primary shelf surface may be rough or smooth or may have areas of each. It may be continuous or discontinuous, ribbed, waffled, etc. It may optionally have one or more drain holes, have a grate-like configuration or be otherwise perforate. For example, it may have through-holes, i.e. holes that extend entirely through the shelf. Such holes may, for example, be positioned between the elongate elements. Optionally, the primary shelf surface may have recesses or common cavities, such as troughs or pockets.

The shelf underside is below the primary shelf surface and, again, "below" should be understood to refer to the surface that faces downwardly in the gravitational sense as the shelf would typically be oriented in an assembled shelving system. For convenience, the shelf underside is referred to as such even when describing the shelf as part of a shelving system that is not assembled but rather packaged for storage or shipment, notwithstanding that the packaged shelving system may be stacked in any position or orientation. It should be understood that the shelf underside may have an irregular configuration. The elongate elements discussed above and other features of the shelf underside may have any suitable configuration, for example, the form of flanges, support or strengthening rails, fins, etc. Further, the shelf underside may have perforations, hooks, pockets, and other formations.

As stated above, the improved shelves disclosed here for a multi-shelf shelving systems comprise a primary shelf surface, a shelf underside below the primary shelf surface, sockets configured to receive an end of a support post for mounting and spacing the shelves when the shelving system is assembled, and a plurality of elongate elements extending along the shelf underside. The elongate elements are unitary with the primary shelf surface and enhance the strength or rigidity of the shelf. They may extend in any direction along the shelf underside. For example, the elongate elements of a shelf that is generally rectangular with a longitudinal direction longer than its lateral direction, extend along the shelf underside lengthwise or widthwise (also in some cases he referred to as longitudinally or laterally, respectively) or diagonally or otherwise. The elongate elements in which the post-receiving recesses are formed where they had any suitable configuration. For example, in certain embodiments the elongate elements are configured along some or their entire length as thin fins or flanges extending vertically downward from the shelf underside in a plane perpendicular to the primary shelf surface. Alternatively, some or all of the elongate elements may be configured as more robust rails extending lengthwise or widthwise along the shelf underside. Alternative configurations for the elongate elements in which the post-receiving recesses are formed will be apparent to those skilled in the art given the benefit of this disclosure.

Optionally some or all of the elongate elements in which the post-receiving recesses are formed are parallel to each other. Optionally they extend along the entire length or width of the shelf, but alternatively some or all may be shorter. As disclosed above, at least some of the post-receiving recesses are generally downwardly-open. As used here, the term "generally downwardly-open" means that the recess opening faces downwardly, that is, away from the primary shelf surface sufficiently at least to allow a support post to be received into the recess when the support post is to be packaged with the shelf, e.g., for shipping or storage. Thus, the recess may be viewed as a concavity in the elongate element. The generally downwardly-open post-receiving recess is configured to receive a support post that is generally horizontal to the primary shelf surface during storage or shipping of the post and shelf together.

In certain embodiments of the shelves disclosed here, at least some of the post-receiving recesses are aligned with each other. That is, the post-receiving recess of one elongate element can be lined-up with the post-receiving recess of another one of the elongate elements, e.g., with the post-receiving recess of an elongate element that is parallel with the first elongate element. With the elongate elements spaced from each other, their respective post-receiving recesses are correspondingly spaced from each other to receive a support post at different points along the length of the support post. In this way, two or more locations along a support post can be received by recesses, such that the support post can be easily positioned. In certain embodiments at least some of the elongate elements have multiple post-receiving recesses in order to accommodate multiple support posts along the shelf underside. Optionally, each of the two or more recesses of a first such multi-recess elongate element can be aligned with corresponding recesses in a second elongate element that is spaced from the first elongate element, e.g. a second elongate element that is parallel to and spaced from the first elongate element. In this way, each of multiple support posts each can be received at multiple points along its length by post-receiving recesses of the elongate elements. Optionally, the multiple support posts, as so received by the recesses of the elongate elements, are parallel to each other. It should be understood that the term "parallel" and other terms of orientation, position etc. are used here broadly to cover both the precise meaning of the term and a more general, less precise meaning. Thus, for example, support posts are "parallel" as that term is used herein in the appended claims if they are parallel with extreme precision or if they are merely sufficiently parallel to be fairly described as such by a casual observer. The same broad approach is intended for other terms of orientation, position etc. used in this disclosure.

In certain embodiments at least some of the recesses are dimensioned to receive the support post tightly or with a friction fit, such that the support post is held securely with little or no movement or rattle noise during handling of a shelving unit that is stacked and packaged for shipment or storage.

It should be understood that certain embodiments of the shelves disclosed here, in addition to the elongate elements described above having post-receiving recesses, may have elongate elements in which there are no such post-receiving recesses. Some or all such elongate elements with no recesses may extend parallel to those with post-receiving recesses, perpendicular to them, diagonal to them or otherwise. Such additional elongate elements may be unitary with the primary shelf surface and further enhance the strength or rigidity of the shelf. Like the elongate elements with post-receiving recesses, those without such recesses may add functionality to the shelf, for example by providing hooks, pockets or other features or functions. Similar to the elongate elements with post-receiving recesses, those (if any) without recesses may extend along the shelf underside of the entire longitudinal or lateral dimension of the shelf or maybe shorter. Others of the elongate elements may extend around the perimeter of the shelf, for example in the form of strengthening rails or as an aesthetically useful skirt along some or all of the outer perimeter of the shelf. A perimeter skirt may be unitary with and extend downwardly from the primary shelf surface along at least a portion of the periphery of the primary shelf surface, and may at strength and/or rigidity to the shelf. It should be understood that the primary surface may blend smoothly and/or with a large radius of curvature into the perimeter skirt, with no clear demarcation where the primary surface ends and the skirt begins.

As noted above, at least certain embodiments of the improved shelves disclosed here have multiple sockets for receiving the support posts. The number and location of the sockets will be determined primarily by the design and intended use of the shelving assembly. If he certain embodiments the shelves all our generally rectangular with a socket located at each of the four corner areas. The term "corner area" is used here broadly in line with the discussion above regarding the breadth of terms of position and orientation. Thus, a socket located at a corner area is not necessarily at the extreme outer edge of the primary shelf surface, more precisely at the juncture of two sides of the shelf.

It will be within the ability of those skilled in the art to make improved shelves in accordance with the present disclosure. Suitable manufacturing techniques include, for example, injection molding the shelves as a unitary structure, i.e., as a one-peace unit. Such injection molded embodiments can be formed of any suitable plastic material, for example, polypropylene, polyethylene, etc. Reinforced plastic can be used for greater strength and rigidity. Similarly, reaction injection molding can be used. Optionally, insert molding can be used to wholly or partly embed one or more items into the injection molded plastic shelf, for example, hooks, strengthening members, aesthetic features, etc.

In accordance with one aspect of the present disclosure, shelving systems are provided comprising multiple shelves, including at least one of the improved shelves described above and a corresponding number of support posts for assembling the shelves together into a shelving unit. In certain embodiments multiple shelves of the shelving system are in accordance with the improved shelves described above, each having post-receiving recesses in the elongate elements extending along the shelf underside, where such post-receiving recesses are sized to receive the support posts of the shelving system. In certain embodiments of the shelving systems disclosed here, all of the shelves of the shelving system are in accordance with the approved shelves described above. In certain embodiments all of the shelves of the shelving system are identical to each other. Where a shelving system has multiple of the improved shelves described above, the shelving system may be packaged for shipment or storage with the shelves stacked closely together, two of the improved shelves stacked next to each other with their shelf undersides facing each other and some or all of the support posts stowed between them in the post-receiving recesses. For example, a shelving system in accordance with the present disclosure may have four shelves, each of which is of the improved type described above, and 12 support posts. The shelving system can be packaged for shipment or storage with a first pair of the shelves stacked adjacent each other and having their shelf undersides facing each other, and a second pair of the shelves stacked adjacent each other and having their shelf undersides facing each other. The first pair shelves is stacked adjacent the second pair shelves. Some of the support posts are stowed between the shelves of the first pair and the remainder of the support posts are stowed between the shelves of the second pair. The support posts are received by recesses in elongate members of the shelves such that the shelves of each pair can be immediately adjacent each other, for example, with the bottom edges of their perimeter skirts touching each other. In this way, the shelving system can be packaged more compactly, with corresponding space and cost efficiency in shipment and storage of multiple such shelving systems.

Referring now to the appended drawings, FIG. 1 is a perspective view of an assembled shelving system in 5 accordance with the present disclosure. The shelving system of FIG. 1 has five injection molded plastic shelves. It will be understood, however, given the benefit of the present disclosure, that a different embodiment of the shelving systems disclosed here may have a different number of shelves. For example, a multi-shelf shelving system in accordance with the present disclosure could have two or more of the illustrated shelves, e.g. four or six such shelves, together with a corresponding number of support posts. In the illustrated embodiment, all five shelves are identical, and for convenience the reference numbers used in the drawings for the various features of the shelves are not repeated for every shelf and post. Rather, only one or a few of the shelves and posts are labeled. Those skilled in the art will understand that the identical features all the shelves could be correspondingly labeled. The shelves are improved in accordance with the present disclosure, as further discussed below. The shelving system further comprises corresponding support posts 8 received in sockets 16-19 of the shelves to support and space the shelves in the assembly.

Figure 2:
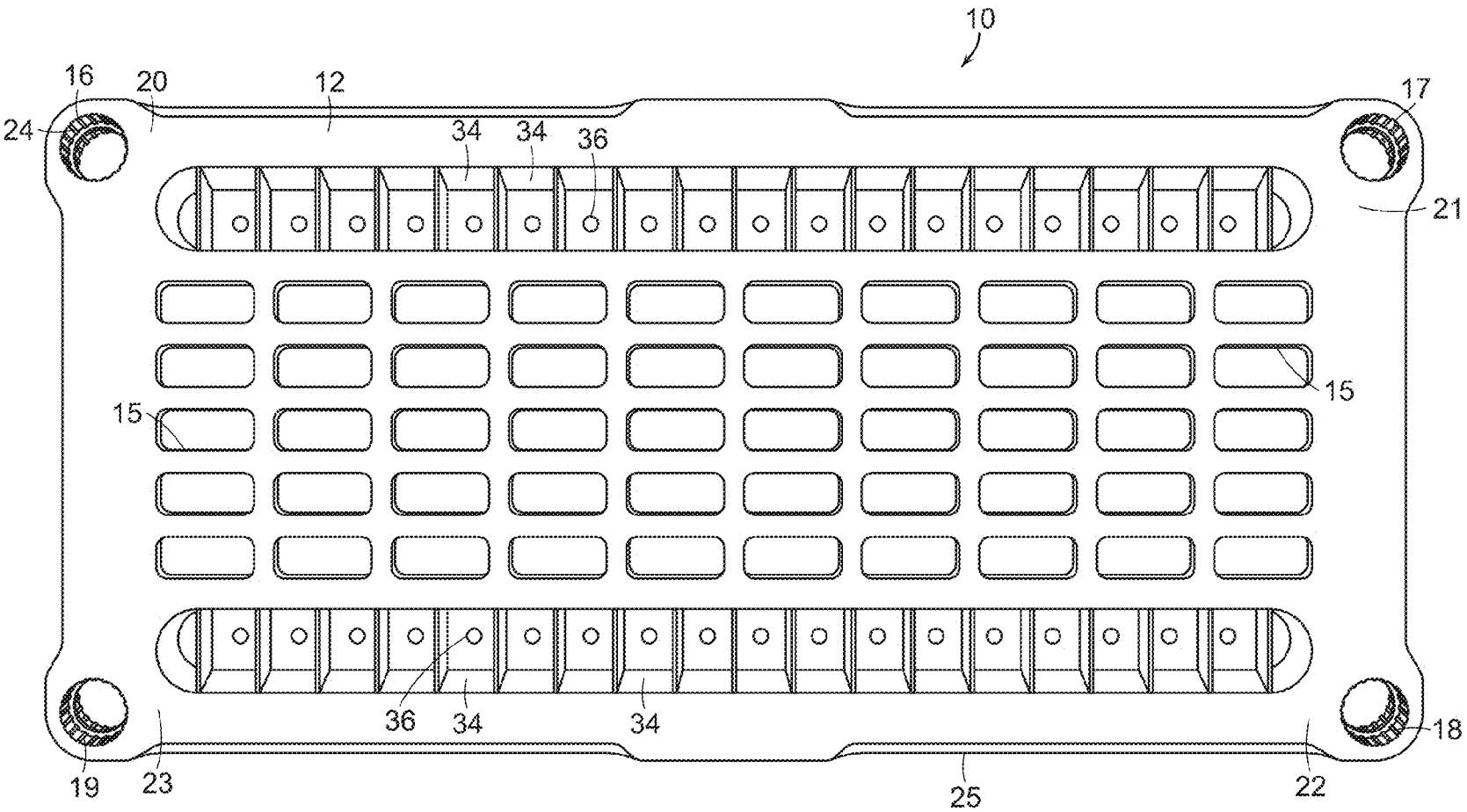
FIG. 2 is a top view of any one of the improved shelves of the shelving system of FIG. 1.
Figure 3:
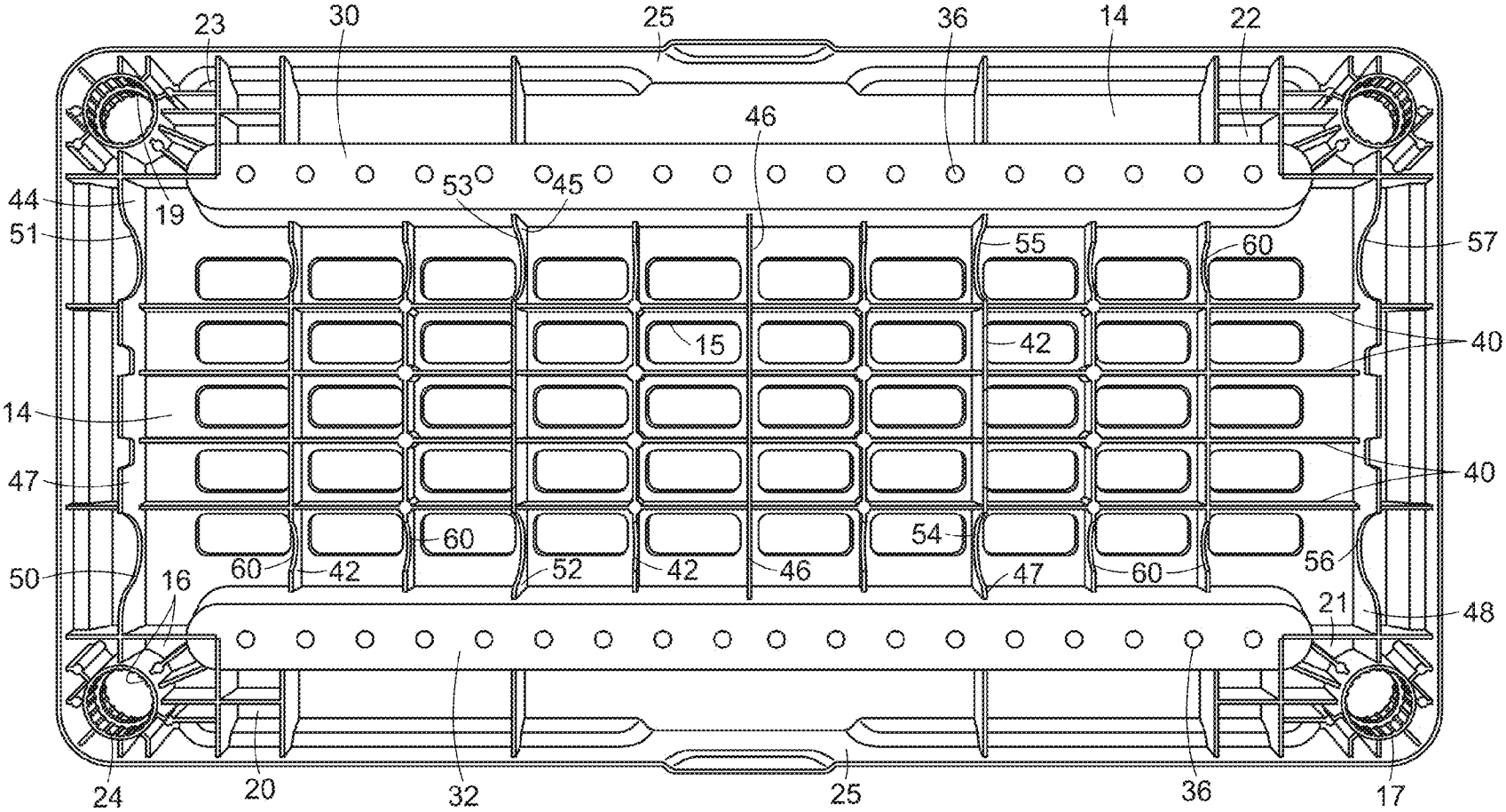
FIG. 3 is a bottom view of the improved shelf of FIG. 2.
Figure 4:
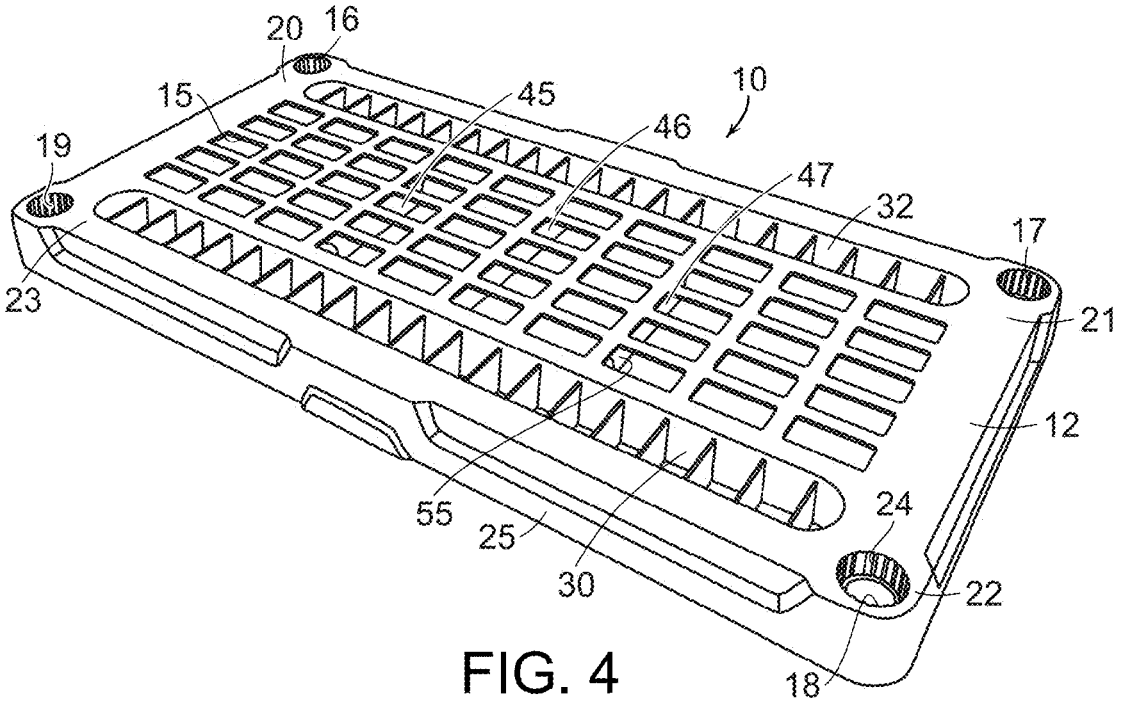
FIG. 4 is a perspective view of the improved shelf of FIG. 2.

FIGS. 2-4 illustrate the improved shelf of the shelving assembly of FIG. 1. The illustrated shelf 10 is a one-piece injection molded plastic unit and is seen to be generally planar, having a primary shelf surface 12 and a shelf underside 14 which would be below the primary shelf surface 12 when the shelf is assembled into the shelving unit. The primary shelf surface is perforate, with rows of through-holes 15 extending through the shelf. A plurality of sockets 16-19 at the corner areas 20-23 of the shelf are seen to have a round cross-section in order to receive the end of tubular support posts (not shown) of correspondingly round cross-sectional configuration and size. It can be seen that the inner wall of the socket in the illustrated embodiment each has a plurality of vertically running ribs or ridges 24 extending from the lower edge to the upper edge. The ribs are evenly spaced circumferentially around the inner wall of the sockets. Advantageously, such ridges can help to tightly receive the end of a support post inserted into the socket. Alternatively, the sockets may be smooth walled. The exterior surface of the support posts at the entrance of the support posts received by the sockets may be smooth or ribbed. The shelf has a perimeter skirt 25 which also adds strength and rigidity to the shelf as well as an aesthetic value.

The shelf underside 14 is seen to have a pair of rails 30, 32 which are parallel to and spaced from each other. The rails add strength and rigidity to the shelf. In alternative embodiments more or fewer rails may be used and they may be differently positioned or oriented. In the illustrated embodiment the rails have a curved lower surface. Alternatively, in other embodiments such strengthening rails may be flat bottomed or oppositely curved. As best seen in FIG. 2, the strengthening rails 30, 32 each provides a series of storage pockets 34 in the primary shelf surface. Advantageously, each of the storage pockets has a drain hole 36.

The shelf underside 14 has longitudinal or lengthwise running parallel ribs 40 evenly spaced between the rails 30, 32, and lateral or widthwise running parallel ribs 42. The ribs add strength and rigidity to the shelf. The illustrated shelf can be seen to have additional strengthening ribs and flanges in addition to those specifically mentioned above. Notably, the shelf has lateral or widthwise running fins 44-48. The fins are parallel to each other and to the lateral ribs 42. Each of fins 44, 45, 47 and 48 has post-receiving recesses configured and sized to receive support posts corresponding to the sockets 16-19. Specifically, fin 44 has post-receiving recesses 50, 51. Fin 45 has post-receiving recesses 52, 53. Fin 47 has post-receiving recesses 54, 55. Fin 48 has post-receiving recesses 56, 57. In the illustrated embodiment fin 46 has no post-receiving recesses and, rather, can act as a stall or barrier to prevent or limit longitudinal sliding of the posts. It can be seen that post-receiving recesses 50 and 52 are aligned to receive a first support post at different positions along its length. Similarly, post-receiving recesses 51 and 53 are aligned to receive a second support post at different positions along its length. Post-receiving recesses 54 and 56 are aligned to receive a third support post at different positions along its length. Post-receiving recesses 55 and 57 are aligned to receive a fourth support post at different positions along its length. In stacking and packaging a shelving system comprising, for example, four shelves of the form illustrated in the drawings, a second set of four support posts would be received by the corresponding recesses of a second such shelf. Likewise, a third set of four support posts would be received by the recesses of the third shelf, and the fourth set of four support posts would be received by the recesses of the fourth shelf. The shelves could be stacked in pairs, the underside of each shelf facing the underside of an adjacent shelf. In that way, all of the support posts are captured between the shelves, and only the primary shelf surface is visible, rather than a shelf underside being visible. Alternatively, for example, the shelves could be stacked adjacent each other and all facing the same direction. Those skilled in the art will recognize that numerous alternative configurations are possible to provide the post-receiving recesses in elongate elements extending along the underside of the shelves.

In the illustrated embodiment, some of the lateral or widthwise running parallel ribs 42 have shallow recesses 60. The shallow recesses 60 are seen to be aligned with the primary recesses described above. The shallow resources advantageously receive or accommodate the support posts when the support posts are stowed along the underside of the shelf. The illustrated shelf is seen to have various additional cutouts and the like which can provide a material reduction and consequent cost and weight savings. As noted above, shelves in accordance with alternative embodiments may have additional and/or different strengthening members, perforations, weight-reducing cutouts etc.

Although the subject matter has been described with reference to specific embodiments and particular features, it should be understood that the subject matter defined in the appended claims is not necessarily limited to those specific embodiments or features. Rather, the specific embodiments and features described above are disclosed as illustrative of the various aspects of the inventive subject matter.

What is claimed is:

1. A shelf for a multi-shelf shelving system, comprising:

a primary shelf surface having a longitudinal direction and a lateral direction, the longitudinal direction being larger than the lateral direction;

a shelf underside below the primary shelf surface;

a pair of rails extending longitudinally along the shelf underside, each rail defining a plurality of pockets in the primary shelf surface, each pocket having a bottom surface and a drain hole formed in the bottom surface;

a plurality of sockets configured to receive an end of a corresponding support post; and a plurality of elongate elements extending laterally along at least a portion of the shelf underside, that are unitary with the primary shelf surface and enhance the strength or rigidity of the shelf;

wherein each elongate element of at least a first set of the elongate elements extends laterally along the shelf underside and has at least one generally downwardly open post-receiving recess having a surface that mates with a cross-sectional surface of the support post, is configured to receive the support post generally horizontal to the primary shelf surface during storage or shipping of the post and shelf together, and restricts lateral movement of the support post.

2. The shelf of claim 1 wherein the elongate elements of the first set of the elongate elements are parallel to each other, and the post-receiving recess of a first elongate element of the first set of the elongate elements is aligned with the post-receiving recess of at least a second elongate element of the first set of the elongate elements, and the first and second elongate elements are spaced from each other to receive the same support post in their respective post-receiving recess during storage or shipping of the post and shelf together.

3. The shelf of claim 1 wherein the elongate elements of the first set of the elongate elements are configured at least in part as flanges extending vertically from the shelf underside in a plane perpendicular to the primary shelf surface.

4. The shelf of claim 1 wherein the post-receiving recess of a first elongate element of the first set of the elongate elements is aligned with the post-receiving recess of at least a second elongate element of the first set of the elongate elements to receive spaced locations of the same support post positioned longitudinally under and generally parallel to the primary shelf surface during storage or shipping of the post and shelf together.

5. The shelf of claim 4 further comprising a second plurality of elongate elements, each extending longitudinally along at least a portion of the shelf underside, that are unitary with and enhance the strength or rigidity of the primary shelf surface.

6. The shelf of claim 1 wherein the post-receiving recesses are curvilinear.

7. The shelf of claim 1 wherein the post-receiving recesses are semicircular.

8. The shelf of claim 1 wherein:

each elongate element of a second set of the elongate elements has at least one generally downwardly-open post-receiving secondary recess configured to receive the support post generally horizontal to the primary shelf surface during storage or shipping of the post and shelf together, and each of the post-receiving secondary recesses is more shallow than and aligned with one of the post-receiving recesses of the first set of the elongate elements.

9. The shelf of claim 1 wherein the primary shelf surface is perforate.

10. The shelf of claim 1 wherein the primary shelf surface has through-holes to the shelf underside positioned between the elongate elements.

11. The shelf of claim 1 further comprising a skirt portion unitary with and extending downwardly from the primary shelf surface along at least a portion of the periphery of the primary shelf surface.

12. An injection molded shelf for a shelving system, comprising:

an upwardly facing primary shelf surface that is generally rectangular with a longitudinal direction and a lateral direction, the longitudinal direction being larger than the lateral direction;

a shelf underside below the primary shelf surface;

a pair of rails extending longitudinally along the shelf underside, each rail defining a plurality of pockets in the primary shelf surface, each pocket having a bottom surface and a drain hole formed in the bottom surface;

a plurality of vertically extending circular sockets in the shelf including at least one socket at each corner area of the primary shelf surface configured to receive an end of a correspondingly tubular support post; and a plurality of elongate elements extending parallel to each other along at least a portion of the shelf underside, being unitary with the primary shelf surface and enhancing the strength or rigidity of the shelf;

wherein each elongate element of at least a first set of the elongate elements extends laterally along the shelf underside and has multiple generally downwardly-open, semi-circular post-receiving recesses having a surface that mates with a cross-sectional surface of a tubular support post that fits in one of the circular sockets, is configured to receive the tubular support post generally horizontal to the primary shelf surface during storage or shipping of the post and shelf together, and restricts lateral movement of the support post, wherein at least first and second post-receiving recesses of a first elongate element of the first set of the elongate elements are aligned, respectively, with first and second post-receiving recesses of a second elongate element of the first set of the elongate elements, and wherein the first and second elongate elements are spaced from each other such that during storage or shipping of the shelf together with at least first and second support posts:

the first post-receiving recesses of the first and second elongate elements can receive the first support post oriented along the shelf underside perpendicular to the first and second elongate elements, and the second post-receiving recesses of the first and second elongate elements can receive the second support post oriented along the shelf underside parallel to the first support post and perpendicular to the first and second elongate elements.

13. The shelf of claim 12 wherein the primary shelf surface, the shelf underside, the plurality of sockets and the elongate members of the first set of the elongate members are unitary with each other.

14. The shelf of claim 12 wherein the first set of the elongate members has more than two elongate members.

15. A shelving system comprising multiple injection molded shelves and multiple support posts, wherein at least one of the injection molded shelves comprises:

an upwardly facing primary shelf surface having a longitudinal direction and a lateral direction, the longitudinal direction being larger than the lateral direction;

a shelf underside below and unitary with the primary shelf surface;

a pair of rails extending longitudinally along the shelf underside, each rail defining a plurality of pockets in the primary shelf surface, each pocket having a bottom surface and a drain hole formed in the bottom surface;

a plurality of vertically extending sockets in the shelf, each configured to receive an end of a corresponding one of the support posts; and a plurality of elongate elements extending along at least a portion of the shelf underside, that are unitary with the primary shelf surface and enhance the strength or rigidity of the shelf;

wherein each elongate element of at least a first set of the elongate elements extends laterally along the shelf underside and has multiple generally downwardly-open post-receiving recesses each having a surface that mates with cross-sectional surfaces of the support posts, is configured to receive one of the support posts generally horizontal to the primary shelf surface during storage or shipping of the post and shelf together, and restricts lateral movement of the support post, and wherein first and second post-receiving recesses of a first elongate element of the first set of the elongate elements are aligned, respectively, with first and second post-receiving recesses of a second elongate element of the first set of the elongate elements, and wherein the first and second elongate elements are spaced from each other such that during storage or shipping of the shelf together with the support posts:

the first post-receiving recesses of the first and second elongate elements can receive a first support post oriented along the shelf underside perpendicular to the first and second elongate elements, and the second post-receiving recesses of the first and second elongate elements can receive a second support post oriented along the shelf underside parallel to the first support post and perpendicular to the first and second elongate elements.

16. A shelving system comprising multiple injection molded shelves and multiple support posts packaged for shipment or storage, wherein the shelves:

each have a plurality of sockets configured to receive an end of a corresponding one of the support posts, and are stacked parallel to each other with the support posts located between adjacent ones of the shelves, and wherein at least a first shelf of the multiple injection molded shelves comprises:

a primary shelf surface;

a shelf underside below and unitary with the primary shelf surface; and a plurality of elongate elements spaced from each other and extending along at least a portion of the shelf underside, that are unitary with the primary shelf surface and enhance the strength or rigidity of the shelf; and wherein each elongate element of at least a first set of the elongate elements has multiple post-receiving recesses, each having a surface that mates with a cross-sectional surface of one of the support posts, and wherein first and second post-receiving recesses of a first elongate element of the first set of the elongate elements are aligned, respectively, with first and second post-receiving recesses of a second elongate element of the first set of the elongate elements, the first post-receiving recess of the first elongate element and the first post-receiving recess of the second elongate element of the first shelf has received a first support post positioned between the first shelf and a second shelf of the multiple injection molded shelves, oriented perpendicular to the first and second elongate elements, and restricts lateral movement of the first support post, and the second post-receiving recess of the first elongate elements and the second post-receiving recess of the second elongate element of the first shelf has received a second support post positioned between the first shelf and the second shelf, oriented perpendicular to the first and second elongate elements, and restricts lateral movement of the second support post, and the size and shape of the second shelf are the same as the size and shape, respectively, of the first shelf, and the shelf underside of the first shelf is stacked facing the shelf underside of the second shelf, with the first and second support posts received also by post-receiving recesses of elongate elements of the second shelf.

17. The shelving system of claim 16, wherein the support posts are tubular with a round cross-section and the post-receiving recesses of elongate elements of the first and second shelves are semi-circular.

* * * * *